US011535419B2

(12) United States Patent
Ronchetti et al.

(10) Patent No.: US 11,535,419 B2
(45) Date of Patent: Dec. 27, 2022

(54) SHEET PACKAGING MATERIAL FOR PRODUCING SEALED PACKAGES FOR POURABLE FOOD PRODUCTS, SEALED PACKAGE FOR POURABLE FOOD PRODUCTS AND A METHOD OF MANUFACTURING A SEALED PACKAGE FOR POURABLE PRODUCTS

(71) Applicant: TETRA LAVAL HOLDINGS & FINANCE S.A., Pully (CH)

(72) Inventors: Luca Ronchetti, Carpi (IT); Marcello Barbieri, Modena (IT); Marco Poppi, Modena (IT); Alberto Mameli, Modena (IT); Roberto De Pietri Tonelli, Colombaro di Formigine (IT); Andrea Giampieri, Modena (IT); Davide Morciano, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 17/260,115

(22) PCT Filed: Jul. 9, 2019

(86) PCT No.: PCT/EP2019/068381
§ 371 (c)(1),
(2) Date: Jan. 13, 2021

(87) PCT Pub. No.: WO2020/016055
PCT Pub. Date: Jan. 23, 2020

(65) Prior Publication Data

US 2021/0269189 A1 Sep. 2, 2021

(30) Foreign Application Priority Data

Jul. 16, 2018 (EP) ..... 18183771

(51) Int. Cl.
*B65D 5/06* (2006.01)
*B31B 50/26* (2017.01)
*B31B 100/00* (2017.01)

(52) U.S. Cl.
CPC ..... *B65D 5/064* (2013.01); *B31B 50/262* (2017.08); *B31B 2100/0028* (2017.08)

(58) Field of Classification Search
CPC ..... B65D 5/064; B65D 5/4266; B65D 5/067; B65D 5/563; B65D 5/4279; B65D 5/56;
(Continued)

(56) References Cited

U.S. PATENT DOCUMENTS 3,412,922 A 11/1968 Miller et al.
D668,539 S * 10/2012 Barbieri ..... D9/431
(Continued)

FOREIGN PATENT DOCUMENTS

CN 102320416 A 1/2012
CN 104309259 A 1/2015
(Continued)

OTHER PUBLICATIONS

U.S. Appl. No. 17/260,085, filed Jan. 13, 2021, Luca Ronchetti et al.
(Continued)

*Primary Examiner* — Christopher R Demeree
(74) *Attorney, Agent, or Firm* — Buchanan Ingersoll & Rooney PC

(57) ABSTRACT

There is described a pre-creased sheet packaging material for forming a sealed package comprising: a plurality of longitudinal crease lines, which extend along a longitudinal direction; a plurality of transversal crease lines, which extend along a transversal direction; at least one first additional crease line, which extends along a further direction, which is slanted with respect to longitudinal direction and
(Continued)

transversal direction; a first joining point, at which longitudinal crease line and a transversal crease line join with respect to one another; and at least one first area, which is bounded by longitudinal crease line, transversal crease line and additional crease line; further direction being incident to first longitudinal crease line and to first transversal crease line in first joining point; at least one of first longitudinal crease line, first transversal crease line and first additional crease line being interrupted at first joining point.

17 Claims, 11 Drawing Sheets

(58) Field of Classification Search
CPC ..... B31B 50/262; B31B 2100/0028; B31B 2155/00; B31B 2170/20; Y10S 229/93; B32B 15/12; B32B 27/10
USPC ... 229/184, 930, 137, 920, 5.84, 198.2, 190, 229/213, 249; 428/172, 211.1, 201; 493/160, 404, 60
See application file for complete search history.

(56) References Cited

U.S. PATENT DOCUMENTS

| | | | | |
|---|---|---|---|---|
| D677,565 | S * | 3/2013 | Barbieri | D9/431 |
| D926,030 | S * | 7/2021 | Barbieri | D9/431 |
| 2017/0253365 | A1* | 9/2017 | Barbieri | B65D 5/067 |
| 2019/0337666 | A1* | 11/2019 | Dammers | B65D 5/064 |
| 2021/0237925 | A1* | 8/2021 | Barbieri | B65D 5/064 |
| 2021/0237926 | A1* | 8/2021 | Barbieri | B65D 5/0209 |
| 2021/0284379 | A1 | 9/2021 | Ronchetti et al. | |

FOREIGN PATENT DOCUMENTS

| | | | |
|---|---|---|---|
| CN | 205470247 | U | 8/2016 |
| CN | 106715277 | A | 5/2017 |
| CN | 107264913 | A | 10/2017 |
| JP | 2017114560 | A | 6/2017 |
| WO | 2017/174320 | A1 | 10/2017 |

OTHER PUBLICATIONS

International Search Report (PCT/ISA/210) dated Oct. 9, 2019, by the European Patent Office as the International Searching Authority for International Application No. PCT/EP2019/068381.
Written Opinion (PCT/ISA/237) dated Oct. 9, 2019, by the European Patent Office as the International Searching Authority for International Application No. PCT/EP2019/068381.
Office Action (The First Office Action) dated Jun. 1, 2022, by the State Intellectual Property Office of People's Republic of China in corresponding Chinese Patent Application No. 201980047466.8 and an English Translation of the Office Action. (13 pages).

* cited by examiner

SHEET PACKAGING MATERIAL FOR PRODUCING SEALED PACKAGES FOR POURABLE FOOD PRODUCTS, SEALED PACKAGE FOR POURABLE FOOD PRODUCTS AND A METHOD OF MANUFACTURING A SEALED PACKAGE FOR POURABLE PRODUCTS

The present invention relates to a sheet packaging material for producing sealed packages for pourable food products.

The present invention also relates to a sealed package for pourable food products.

The present invention also relates to a method of manufacturing a sealed package for pourable food products.

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by creasing and sealing a laminated web of packaging material. The packaging material has a multilayer structure comprising a base layer, e.g. of paper, covered on both sides with layers of heat-sealable thermoplastic material, e.g. polyethylene. In the case of aseptic packages for long-storage products, such as UHT milk, the packaging material also comprises a layer of oxygen-barrier material, e.g. an aluminium foil, which is superimposed on a further layer of thermoplastic material and is in turn covered with another layer of heat-sealable thermoplastic material forming the inner face of the package eventually contacting the food product.

This known package comprises:

- a rectangular bottom wall which is crossed by a bottom transversal seal;
- a rectangular top wall, which is crossed by a top transversal seal;
- a rear wall which extends between corresponding first edges of top and bottom wall;
- a front wall which is opposite to the rear wall and extends between corresponding second edges, opposite to first edges, of top and bottom walls; and
- a pair of lateral walls interposed between the bottom and top walls, and between rear and front walls.

Furthermore, the package comprises a top transversal sealing band and a bottom transversal sealing band, which extend across respective top wall and bottom wall.

The top sealing band extends beyond the top wall of packages into respective flat, substantially triangular flaps, which are folded coplanar with and onto upper portions of respective lateral walls as of the top wall.

The bottom sealing band comprises a main portion folded over the bottom wall and a pair of lateral portions, which are folded over the main portion. The main portion is folded onto bottom wall while the lateral portions form two respective flat, substantially triangular lateral bottom flaps of packaging material folded over the main portion.

Furthermore, the substantially triangular flaps are folded coplanar with and onto respective lateral portions of the bottom sealing band as of the lower portions of respective lateral walls.

In the known packages, flaps are shaped as isosceles triangular with two angles of 45 degrees or of more than 45 degrees.

The packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; the web so sterilized is then maintained in a closed, sterile environment, and is folded and sealed longitudinally to form a tube, which is fed vertically.

Alternatively, the packaging material may be sterilized according to other technique, e.g. by using low voltage electron beams.

The tube is filled with the sterilized or sterile-processed food product, and, in order to complete the forming operations, is sealed and subsequently cut along equally spaced cross sections.

More precisely, the tube is sealed longitudinally and transversally to its own axis, to form pillow packs, which will be eventually folded to form finished packages with a longitudinal seal and a pair of top and bottom transversal seals.

Alternatively, the packaging material may be cut into blanks, which are formed into packages on forming spindles, and the packages are then filled with the food product and sealed.

In both the cases, the known packages are produced starting by a basic unit of packaging material, which is, in the first case, a portion of a web of packaging material and, in the second case, a precut blank.

In the first case, the web of packaging material comprises a succession of basic units and is:

- folded into a cylinder to form a vertical tube;
- filled continuously with the food product; and
- sealed transversely and cut into the basic units, which are then folded to form successive packages.

In the second case, the basic unit is folded in the forming station is filled with the food product and is sealed at the top and the bottom to form the package.

In both the cases, the basic unit has a crease pattern, i.e. a number of crease lines, which define respective folding lines, along which the packaging material is folded to form the finished packages.

The crease lines bound a plurality of panels, which define the walls and the flaps of the finished package, once the basic unit has been folded.

In detail, the crease lines bound:

- a pair of triangular first panels, which are interposed between respective second triangular panels; and
- a pair of triangular third panels, which are interposed between respective fourth triangular panels.

First (third) panels define respectively the inner wall of top (bottom) flaps of finished packages whereas the second (fourth) panels define respectively the outer walls of top (bottom) flaps of finished packages.

Each first (third) panel is bounded by:

- a segment of a first crease line, which defines the sides of the top wall of the finished package; and
- a pair of second crease lines, which extends between respective opposite ends of the segment and a common end on a third crease line.

The third crease line is parallel to the first crease line.

The second crease lines are sloped relative to the first and third crease lines.

In particular, the second crease lines of each pair define therebetween an angle of ninety degrees.

Even well performing, the previously described known solution leave room for improvement.

In particular, the Applicant has found that the packages could be affected by some forming defects.

A first defect looks like a tip of packaging material protruding from the bottom wall of the package. In the worst cases, such a protruding tip may be quite sharp and cause damages to other packages in handling and distribution of the packages, such as when advancing the packages on conveyors and stacking them onto pallets.

A second defect may affect the bottom corners of the packages, which may then be not perfectly formed, and result in bad appearance of the packages.

A need is felt within the industry to reduce the severity of these defects in a simple and economic way.

It is therefore an object of the present invention to provide a sheet packaging material for producing sealed packages for pourable food products, which meets the above-identified need.

According to the present invention, there is provided a sheet packaging material for producing sealed packages for pourable food products, as claimed in claim 1.

The present invention also relates to a sealed package for pourable food products, as claimed in claim 12.

The present invention also relates to a method of manufacturing a sealed package for pourable food products, as claimed in claim 17.

Six preferred, non-limiting embodiments of the present invention will be described by way of example with reference to the accompanying drawings, in which.

Figure 7:
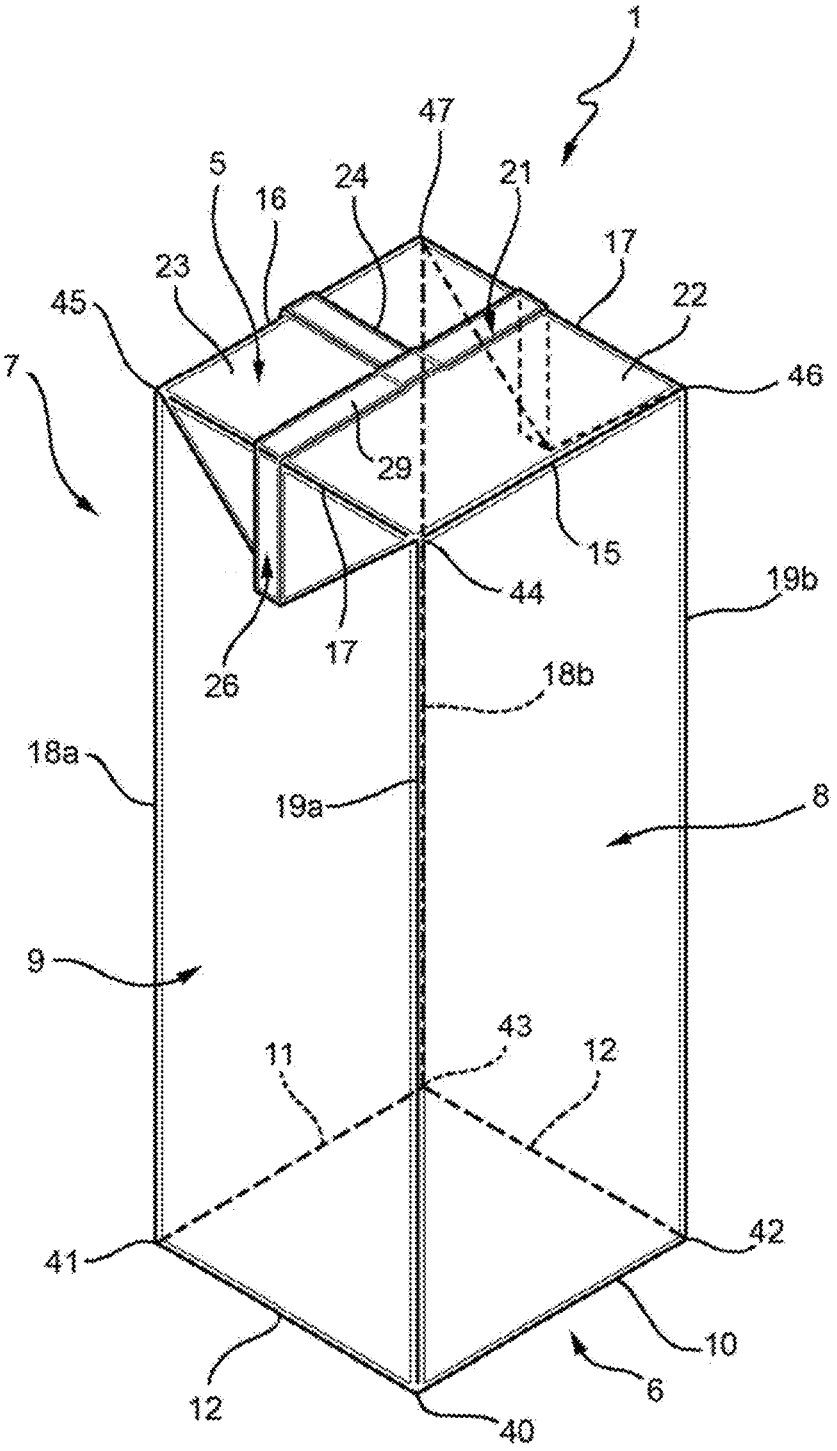
FIG. 7 shows a parallelepiped package formed as one of the sheet packaging material of FIGS. 1 to 5.
Figure 8:
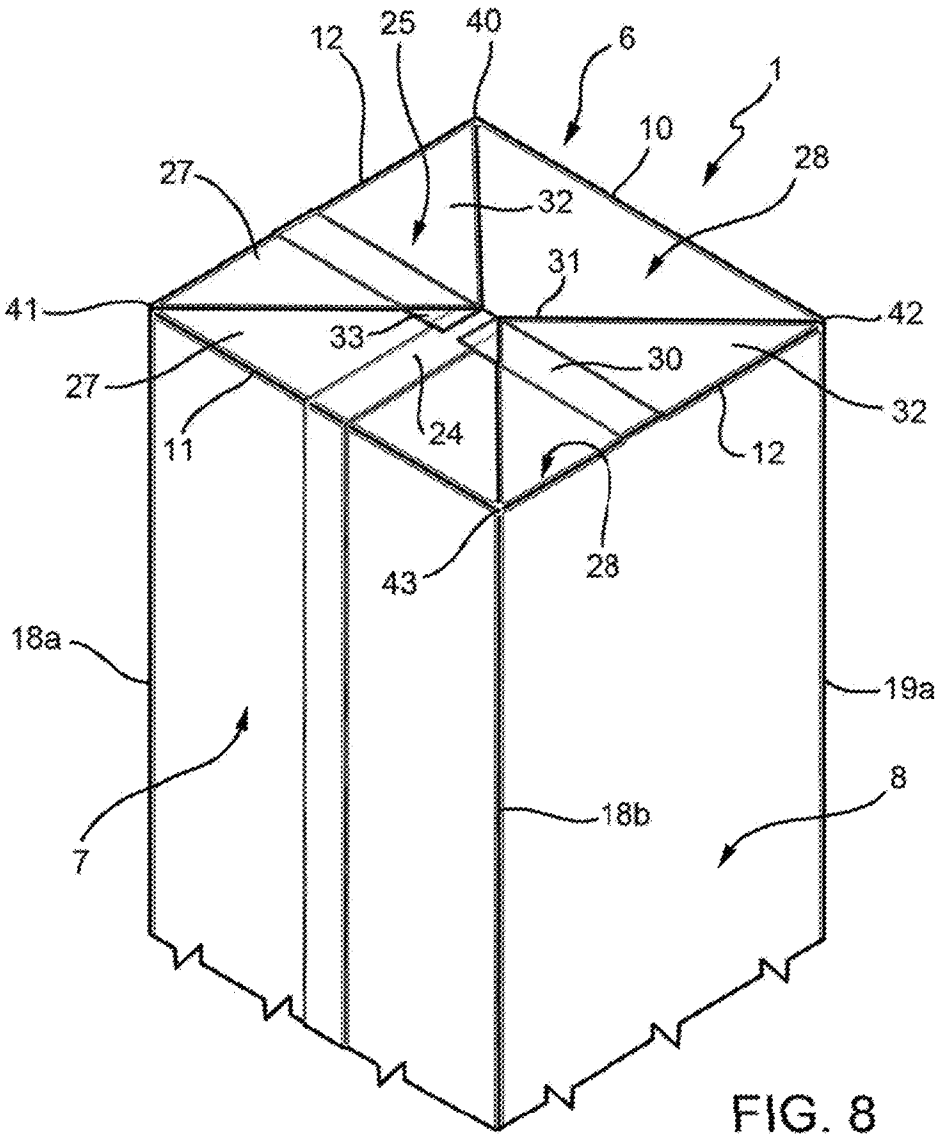
FIG. 8 is an enlarged view of the bottom part of the package of FIG. 7.
Figure 11:
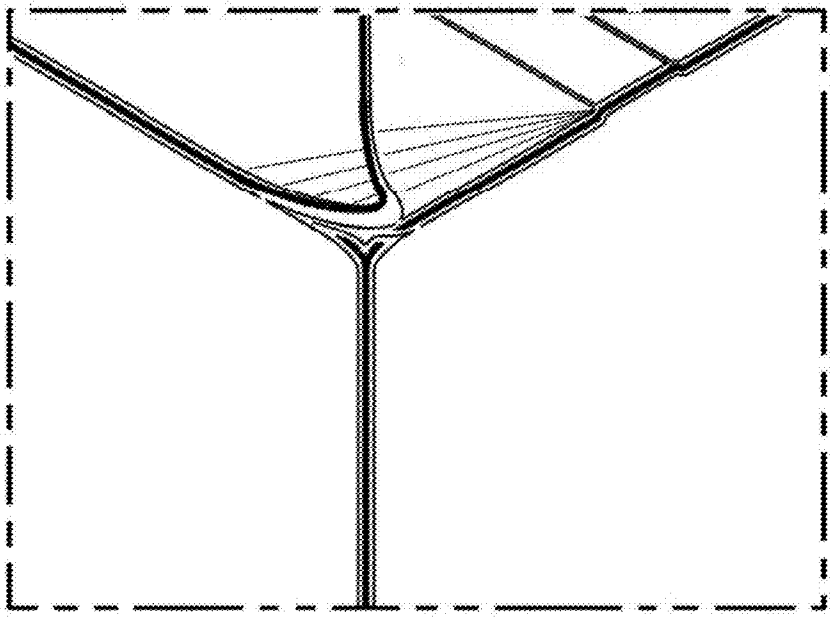
FIG. 11 shows a known package affected by a first kind of forming defect.
Figure 9:
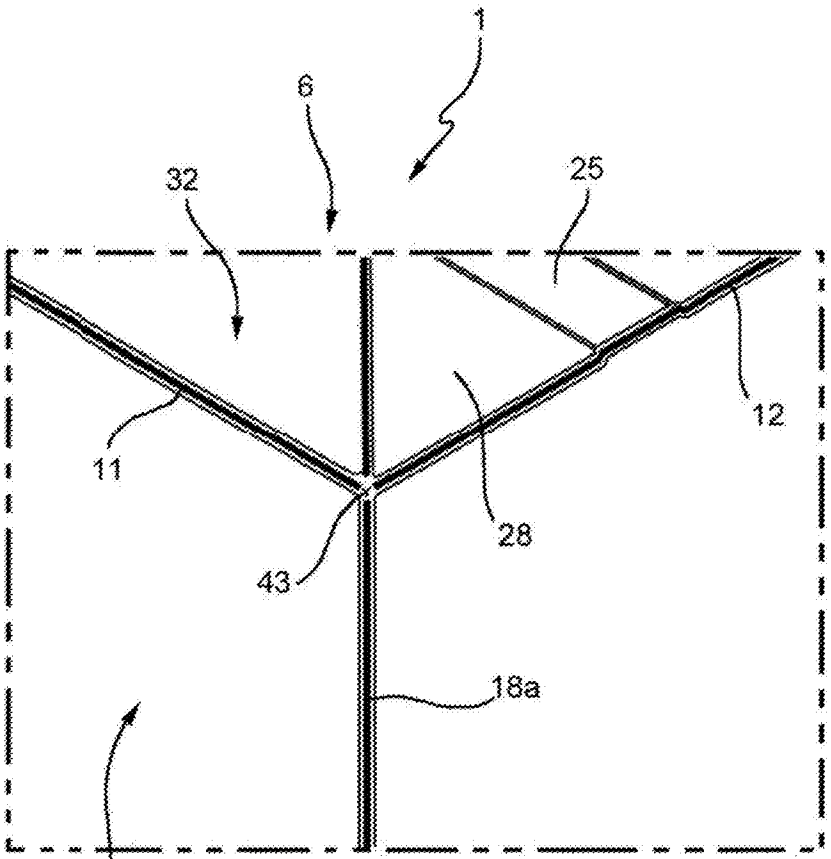
FIG. 9 is a view in a further enlarged scale of some particular of the package of FIG. 8.

Number 1 in FIGS. 7 to 9 indicates as a whole a sealed package for pourable food products, which is made of multilayer sheet packaging material 2 (FIGS. 1 to 5) and may be fitted with a reclosable opening device (not-shown) preferably made of a plastic material.

Package 1 is known as Tetra Brik Aseptic.

Package 1 has preferably a volume of 250 ml or of 1000 ml.

Alternatively, package 1 according to the invention can have a different volume.

In greater detail, package 1 comprises:

- a quadrilateral (in the example shown, rectangular or square) top wall 5;
- a quadrilateral (in this case, rectangular or square) bottom wall 6, which is opposite to top wall 5;
- a flat rear wall 7, which extends between top wall 5 and bottom wall 6;
- a front wall 8, which extends between top wall 5 and bottom wall 6, and is opposite to rear wall 7; and
- two lateral walls 9 opposite to each other, and which extend between top wall 5 and bottom wall 6, and between rear and front walls 7, 8.

Bottom wall 6 comprises two horizontal edges 10, 11 parallel to one another, and two horizontal edges 12 interposed between and orthogonal to edges 10, 11. Edges 12 are parallel to one another.

Top wall 5 comprises two horizontal edges 15, 16, opposite to each other and parallel to one another. More precisely, horizontal edges 15, 16 are parallel to and arranged over edges 10, 11 respectively.

Top wall 5 also comprises two edges 17, which extend between edges 15, 16 and are parallel to one another.

Edges 17 are arranged over respective edges 12.

Rear wall 7 extends between edges 11, 16 and comprises two opposite vertical edges 18*a*, 18*b* which are parallel to one another and extend between edges 11, 16.

Front wall 8 extends between edges 10, 15 and comprises two opposite vertical edges 19*a*, 19*b*, which extend between edges 10, 15.

Each lateral wall 9 is bounded by edge 12, 17, by a relative vertical edge 18*a*, 18*b*, and by a relative vertical edge 19*a*, 19*b*.

Package 1 also comprises:

- a pair of bottom front vertices 40, 42;
- a pair of bottom rear vertices 41, 43;
- a pair of top front vertices 44, 46; and
- a pair of top rear vertices 45, 47.

Edges 10, 19*a* and one of edge 12 intersect with one another at vertex 40.

Edges 10, 19*b* and the other one of edge 12 intersect at vertex 42.

Edges 11, 18*a* and one of edge 12 intersect with one another at vertex 41.

Edges 11, 19*a* and the other one of edge 12 intersect with one another at vertex 43.

Edges 15, 19*a* and one of edge 17 intersect with one another at vertex 44.

Edges 15, 19*b* and the other one of edge 17 intersect at vertex 46.

Edges 16, 18*a* and one of edge 17 intersect with one another at vertex 45.

Edges 16, 18*b* and the other one of edge 17 intersect with one another at vertex 47.

Package 1 also comprises a top transversal sealing band 21 (FIG. 7) and a bottom transversal sealing 25 (FIGS. 8 and 9), which extends across respective top and bottom walls 5, 6.

Top transversal sealing band 21 divides top wall 5 into two portions 22, 23, one (22) of which, adjacent to front wall 8 and bounded by edge 15, defines an area for the potential application of opening device 3, while the other portion (23), adjacent to rear wall 7 and bounded by edge 16, comprises along the centerline, an end portion of a flat longitudinal sealing band 24 of package 1 (FIG. 7).

More specifically, longitudinal sealing band 24 extends perpendicularly between top transversal sealing band 21 and bottom transversal sealing band 25, and substantially along the centerline of rear wall 7.

Top transversal sealing band 21 extends beyond top wall 5 of package 1 into respective flat, substantially triangular lateral top first flaps 26 (only one of which is shown in FIG. 7) of packaging material folded coplanar with and onto respective lateral walls 9 as of top wall 5.

Top transversal sealing band 21 also forms, lengthwise, a rectangular flat top tab 29 projecting from portions 22, 23 and from lateral top flaps 26 and folded onto portions 23 along a bend line formed at the base of tab 29.

With reference to FIGS. 8 and 9, bottom transversal sealing band 25 divides bottom wall 6 into two portions 27, 28, one of which (27) is adjacent to rear wall 7, is bound by edge 11 and comprises along the centerline an end portion of longitudinal sealing band 24.

Bottom transversal sealing band 25 comprises a main portion 30 and a pair of end portions 31, which are arranged on opposite lateral sides of portion 30.

Portion 30 is folded onto bottom wall 6 while portions 31 form two respective flat, substantially triangular lateral bottom flaps 32 of packaging material folded over portion 30.

Bottom transversal sealing band 25 also forms, lengthwise, a flat rectangular bottom tab 33 projecting from portions 27, 28 and which extends into bottom flaps 32. Tab 33 comprises, in turn, a main portion folded over bottom wall 6 and a pair of lateral portions folded onto the main portion of tab 31 itself along a bend line formed at the base of tab 33.

With reference to FIG. 1*a*, packaging material 2 from which package 1 is made has a multilayer structure comprising a base layer, e.g. of paper, for stiffness, and a number of lamination layers covering both sides of base layer.

In the example shown, the lamination layers comprise a first layer of oxygen-barrier material, e.g. an aluminum foil, and a number of second layers of thermoplastic material covering both sides of both base layer and first layer. In other words, such solution comprises, in succession and from the side eventually forming the inside of package 1, a layer of heat-sealable thermoplastic material, a layer of barrier material, another layer of thermoplastic material, base layer, and another layer of heat-sealable thermoplastic material.

The inner layer of heat-sealable thermoplastic material contacting the food product, in use, may, for example, be made of strong thermoplastic polymer, in particular, polyolefins and preferably low density polyethylene (LDPE) further comprising metallocene-catalyzed, low-linear-density (LLD) polyethylene.

Normally, layers of heat-seal plastic material are laminated on the base layer in a melted state, with successive cooling.

As a possible alternative, at least the inner layers of plastic material may be provided as prefabricated films, which are laminated on the base layer.

Figure 1:
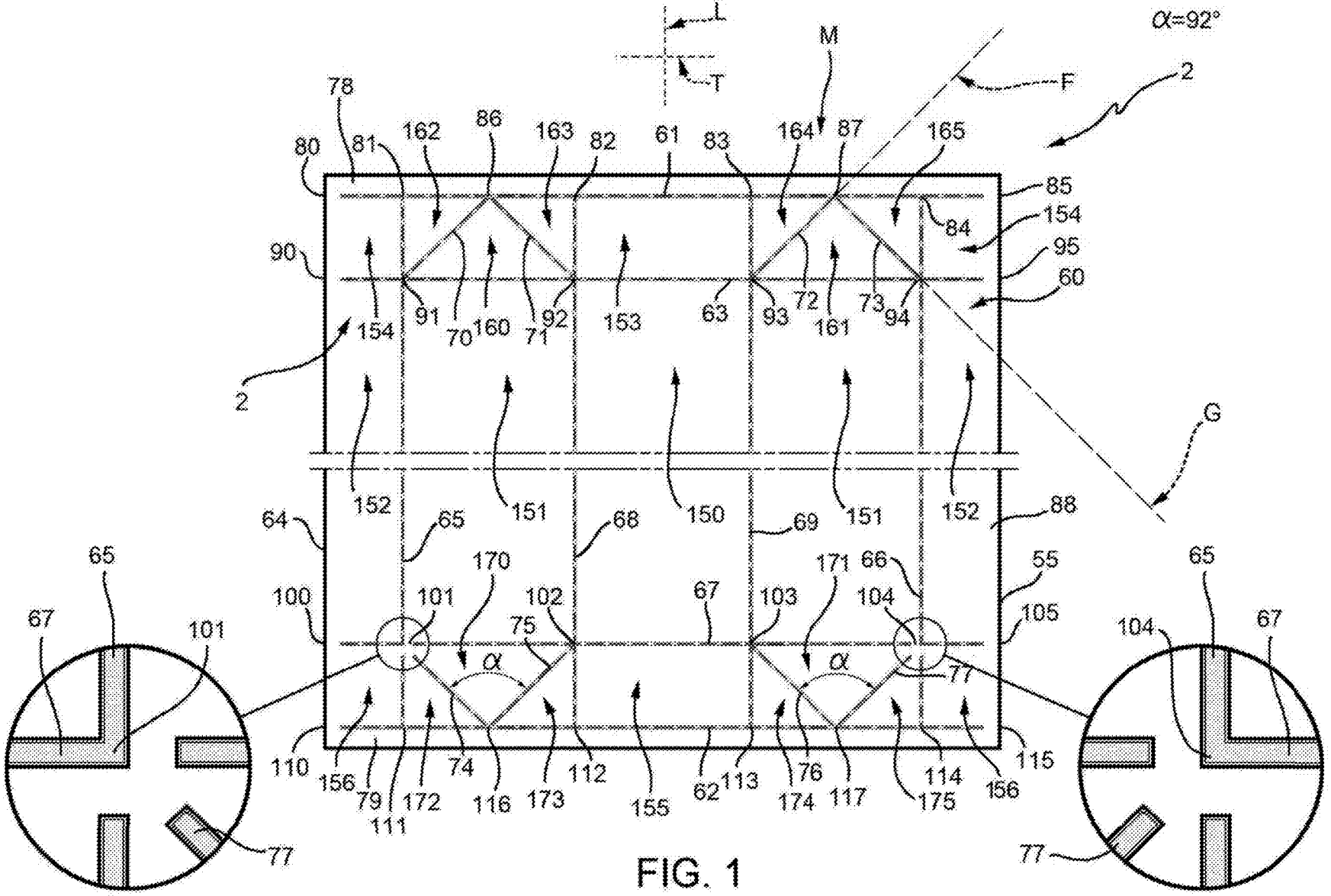
FIG. 1 shows a sheet packaging material according to a first embodiment of the present invention.

Letter M in FIG. 1 indicates a basic unit of packaging material 2, by which to produce package 1, and which may be a precut blank, or a portion of a web of packaging material comprising a succession of units M.

In the first case, basic unit M is folded on a known crease spindle (not shown), is filled with the food product, and is sealed at the top and bottom to form package 1. In the second case, the web of packaging material 2, comprising a succession of basic units M, is:

- folded into a cylinder to form a vertical tube having constant circumference;
- filled continuously with the food product; and
- sealed transversely and cut into basic units M, which are then folded to form respective packages 1.

Basic unit M has a crease pattern 60, i.e. a number of crease lines defining respective fold lines, along which packaging material 2 is folded to form the finished package 1.

Basic unit M has a longitudinal extension along a direction L and a transversal extension along a direction T, which is orthogonal to direction L.

Crease pattern 60 substantially comprises:

- a transversal crease line 63 for forming edges 15, 16, 17 of finished package 1;
- a transversal crease line 67 for forming edges 10, 11, 12 of finished package 1; and
- a pair of transversal crease lines 61, 62 for allowing the folding of top transversal sealing band 21 and of the bottom transversal sealing band 25.

Crease lines 63, 67 are interposed between crease lines 61, 62.

Crease lines 61, 63, 67, 62 are parallel to one another and extend parallel to direction T.

In the embodiment shown, crease lines 61, 63, 67, 62 are spaced from edges 64 and 55 along direction T.

Alternatively, crease lines 61, 63, 67, 62 could extend up to edge 64 and edge 55 along direction T.

Crease pattern 60 further comprises:

- a pair of longitudinal crease lines 65 and crease line 66 parallel to each other;
- a pair of longitudinal crease line 68 and crease line 69 parallel to each other and interposed between crease lines 65 and crease line 66; and
- a pair of longitudinal end edges 64, 55, opposite to one another.

Crease lines 65, 68, 69, 66 and edges 64 and 55 extend parallel to direction L.

In detail, crease line 65, crease lines 66, 68, crease line 69 and edges 64, 55, are parallel to each other and orthogonal to crease lines 63, 67 and crease lines 61, 62.

Crease lines 65, 66, 68, 69 are parallel to direction T.

Still more precisely, crease line 68, 69 are interposed between crease line 65 and crease line 66 along direction T.

Crease lines 65, 66 are, in turn, interposed between edges 64, 55.

Crease pattern 60 also comprises:

- a rectangular end area 78 which is formed between crease line 61 and the edge of the packaging blank; and
- a rectangular end area 79 which is formed between crease line 62 and the edge of the packaging blank.

End area 78 is adapted to form top tab 29 and end area 79 is adapted to form bottom tab 33 of finished package 1, once basic unit M has been folded.

Crease line 61 intersects crease lines 65, 68, 69, 66 respectively at intersection points 81, 82, 83, 84.

Crease line 63 intersects creases line 65, 68, 69, 66 respectively at intersection points 91, 92, 93, 94.

Crease line 67 intersects crease line 65, 68, 69, respectively at intersection points 101, 102, 103, 104.

Crease line 62 intersects creases line 65, 68, 69, 66 respectively at intersection points 111, 112, 113, 114.

In the embodiment shown, the prolongation of crease lines 61, 63, 67, 62 intersects edges 64; 55 respectively at intersection points 80, 90, 100, 110; 85, 95, 105, 115.

As it will be evident from the following of the present description, pattern 60 comprises a plurality of panels which are defined by the previously identified crease lines.

The use of expression "panel" in the present description does not imply that the panels are completely bounded by the crease lines, being clear that, in case of interrupted crease lines, the panels could be defined by respective areas which are defined by the prolongation of the interrupted crease lines and by remaining uninterrupted crease lines.

Pattern 60 comprises (FIG. 1):

- a panel 150, which is bounded by points 92, 93, 102, 103 and is adapted to define the front wall 8 of the finished package 1, once basic unit M has been folded;
- a pair of panels 151 arranged on opposite sides of panel 150 and adapted to define lateral walls 9 of the finished package 1; one panel 151 is defined by points 91, 92, 101, 102 and other panel 151 is defined by points 93, 94, 103, 104; and a pair of panels 152 arranged on opposite sides of respective panels 151 relative to panel 150.

One of panels 152 is defined by point 90, first point 91, 100, 101; the other panel 152 is defined by points 94, 95, 104 and 105.

Panels 152 are adapted to define rear wall 7 of finished package 1, once basic unit M has been folded and edge area 88 has been sealed on edge 64.

Pattern 60 also comprises (FIG. 1):

a rectangular panel 153 defined by points 82, 83, 92, 93 and adapted to define portion 22 of top wall 5;

a pair of rectangular panels 154 arranged laterally with respect to panel 153, defined respectively by points 80, 81, 90, 91 and 84, 85, 94, 95 and adapted to define portion 23 of top wall 5 of finished package 1;

a rectangular panel 155 defined by points 102, 103, 112, 113, and adapted to define first portion of bottom wall 6; and a pair of rectangular panels 156 arranged laterally with respect to panel 155 and adapted to define second portion of bottom wall 6.

In particular, one panel 156 is defined by point 100, 101, 110, 111, and the other panel 156 is defined by point 104, 105, 114 and 115.

Pattern 60 further comprises:

a crease line 70 (72) and a crease line 71 (73), each of which extends between a respective point 91 and a respective point 93 (point 92 and point 94) and a common point 86 (87) which is positioned on crease line 61 and is interposed between points 81, 82 (83, 84); and a fifth crease lines 74 (76) and a crease line 75 (77), each of which extends between a respective point 101, point 102 (points 103, 104) and a common point 116 (117), which is positioned on crease line 62 and is interposed between points 111, 112 (113, 114).

Crease lines 70, 71 (72, 73, 74, 75, 76, 77) are sloped with respect to crease lines 61, 67, 63, 62, edges 64, 55 and creases line 65, 68, 69, 66 and 60.

In particular, crease lines 70, 72, 75, 77 extend parallel to one another and along respective directions F, which are incident points 91, 93, 102 and 104 respectively.

Crease lines 71, 73, 74, 76 extend parallel to one another and along respective directions G, which are incident points 92, 94, 101 and 103 respectively.

Directions F, G are slanted with respect to direction L, T.

Thanks to the presence of crease lines 70, 71, 72, 73, 74, 75, 76, 77, pattern 60 comprises:

a pair of top triangular panels 160; 161 defined by points 86, 91, 92; 87, 93 and 94;

a triangular panel 162 interposed between panels 160, 154, and defined by points 91, 81, 86;

a triangular panel 163 interposed between panels 160, 153, and defined by points 82, 86, second point 92:

a triangular panel 164 interposed between panel 161 and panel 153, and defined by points 83, 87 and further second point 93; and a triangular panel 165 interposed between panel 161 and 154, and defined by points 84, 87, 94.

Points 92, 93, 102, 103 of pattern 60 define respective vertices 44, 46, 40, 42 of finished package 1.

Points 91, 94, 101, 104 of pattern 60 define respective vertices 45, 47, 41, 43 of finished package 1.

Advantageously, at least one of crease lines 67, 74 and 65 is interrupted at point 101.

In the embodiment shown, each one of crease line 67, 74 and 65 is interrupted at point 101.

The prolongations of interrupted crease lines 67, 74 and 65 converge at point 101.

In particular, the portion of crease line 67 interposed between panels 152, 156 and the portion of crease line 65 interposed between panels 152, 151 are joined at point 101, the remaining portions being interrupted at point 101.

Furthermore, at least one of crease lines 66, 67, 77 is interrupted at point 104.

In the embodiment shown, each one of crease line 66, 67 and 77 is interrupted at point 104.

Furthermore, the portions of crease line 67 extending between joining points 101, 102 and 103, 104 define bottom edges of respective panels 151.

The prolongations of interrupted crease lines 66, and 77 converge at point 104. In particular, the portion of crease line 67 interposed between panels 152, 156 and the portion of crease line 65 interposed between panels 152, 151 are joined at point 104, the remaining portions being interrupted at point 104.

An angle $\alpha$ between crease lines 74, 75; 76, 77 ranges between 91 and 93 degrees, and equals, in the embodiment shown, 92 degrees.

Once blank M has been folded to form finished package 1, panels 163, 162, 160, form one top flap 26 while panels 165, 161, 164 form other top flap 26.

Still more precisely, panels 160, 161 define inner surfaces of respective top flaps 26 superimposed on the upper portion of respective lateral walls 9 while panels 162, 163 and 164, 165 define outer surfaces of respective top flaps 26 with respect to lateral walls 9 of finished package 1.

Furthermore, pattern 60 comprises:

a pair of bottom triangular panels 170; 171 defined by points 101, 102, 116; 103, 104 and 117;

a triangular panel 172 interposed between panels 170, 156, and defined by points 101, 111, 116;

a triangular panel 173 interposed between panels 170, 155, and defined by points 102, 112, 116;

a triangular panel 174 interposed between panels 171, 155, and defined by points 103, 117, 113; and a triangular panel 175 interposed between panels 171 and 156, and defined by further points 104, 117, 114.

Once blank M has been folded to form finished package 1, panels 173, 172, 170, form one bottom flap 32 while panels 175, 171, 174 form other bottom flap 32.

Still more precisely, panels 172, 173 and 174, 175 define inner surfaces of respective bottom flaps 32 superimposed on respective bottom walls 6 while second panels 170, 171 define outer surfaces of respective bottom flaps 32 with respect to bottom walls 6 of finished package 1.

Figure 2:
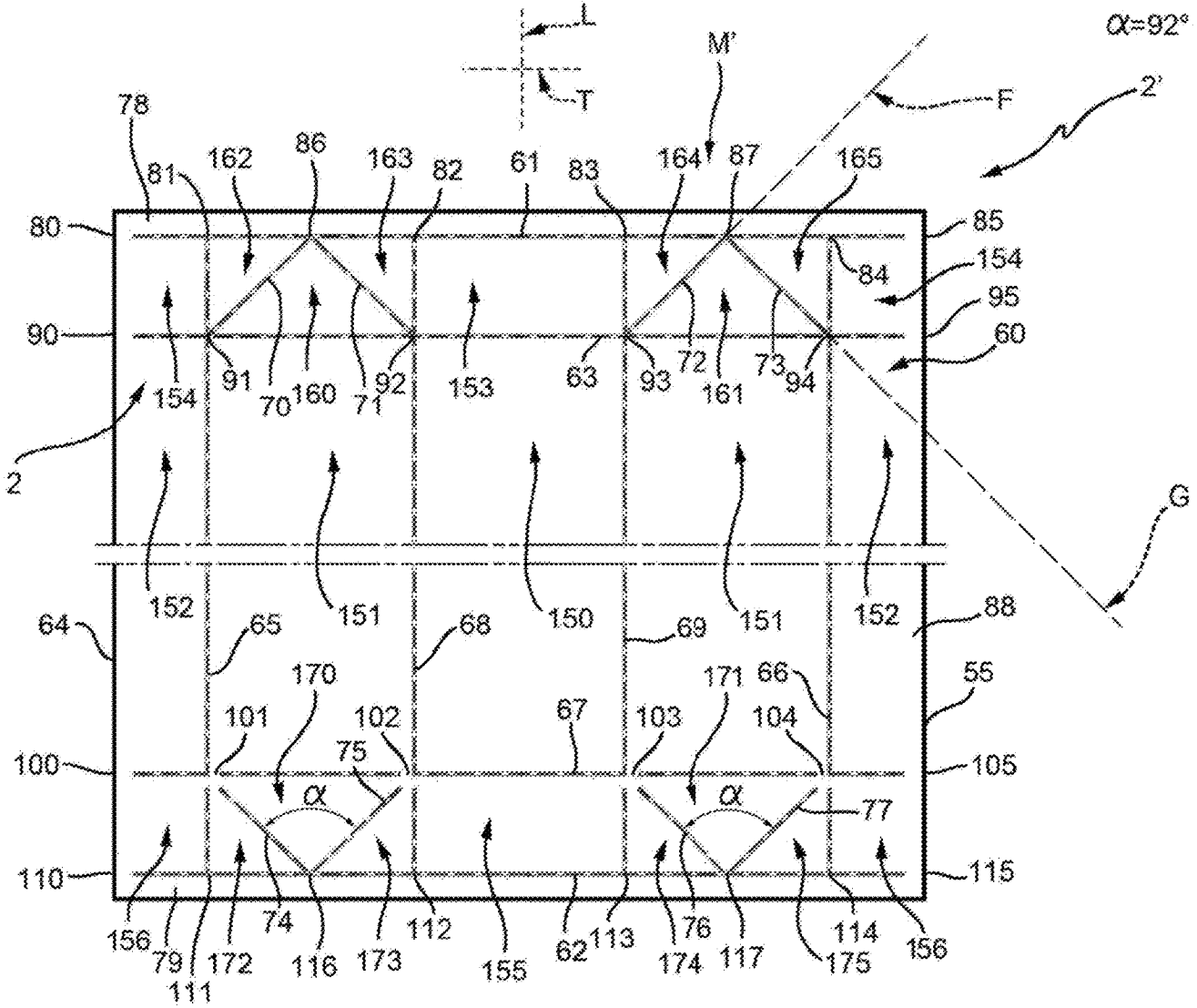
FIGS. 2 to 6 show a sheet packaging material according to respective second, third, fourth, fifth and sixth embodiment of the present invention.

Letter M' in FIG. 2 indicates a second embodiment of a basic unit of packaging material 2', by which to produce package 1; basic units M, M' of packaging material 2, 2' are similar to each other, the following description is limited to the differences between them, and using the same references, where possible, for identical or corresponding parts.

Basic unit M' differs from basic unit M in that at least one of crease lines 67, 75 and 68 is interrupted at point 102.

In the embodiment shown, each one of crease lines 67, 75 and 68 is interrupted at point 102.

The prolongations of interrupted crease lines 67, 75 and 68 converge at point 102.

In particular, the portion of crease line 67 interposed between panels 155, 150 and the portion of crease line 68 interposed between panels 150, 151 are joined at point 102.

Furthermore, basic unit M' differs from basic unit M at least one of crease lines 67, 76, 69 is interrupted at point 103.

The prolongations of interrupted crease lines 67, 76 and 69 converge at point 103.

In particular, the portion of crease line 67 interposed between panels 155, 150 and the portion of crease line 69 interposed between panels 150, 151 are joined at point 103.

In the embodiment shown, each one of crease line 67, 76 and 69 is interrupted at point 103.

Figure 3:
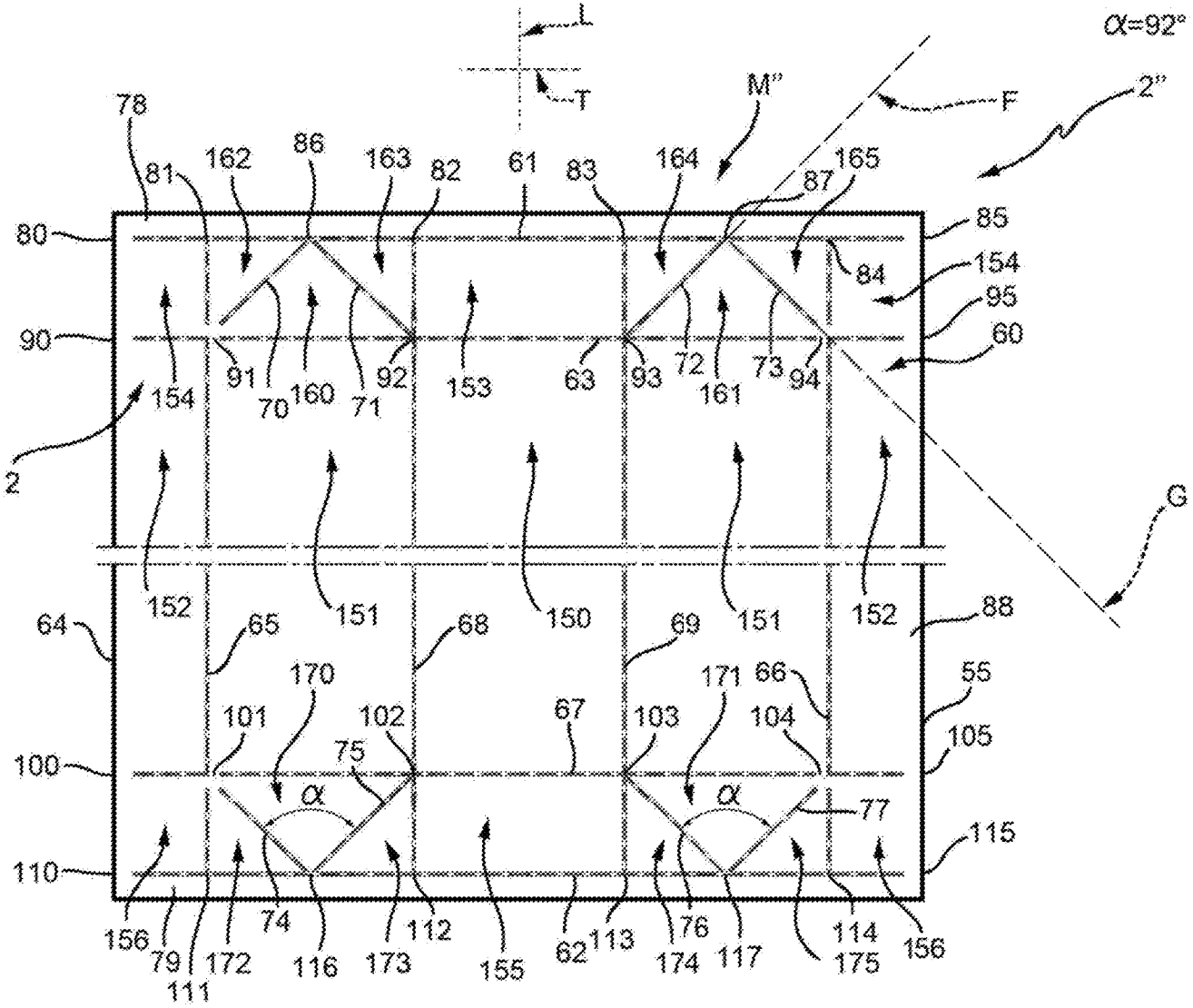

Letter M" in FIG. 3 indicates a third embodiment of a basic unit of packaging material 2", by which to produce package 1; basic units M, M" of packaging material 2, 2" are similar to each other, the following description is limited to the differences between them, and using the same references, where possible, for identical or corresponding parts.

In particular, basic unit M" differs from basic unit M in that that at least one of crease lines 63, 70 and 65 is interrupted at point 91.

In the embodiment shown, each one of crease lines 63, 70, 65 is interrupted at point 91.

Furthermore, basic unit M" differs from basic unit M at least one of crease lines 66, 73, 63 is interrupted at point 94.

In the embodiment shown, each one of crease line 66, 73, 63 is interrupted at point 94.

Furthermore, the portions of crease line 63 extending between joining points 91, 92 and 93, 94 define top edges of respective panels 151.

Figure 4:
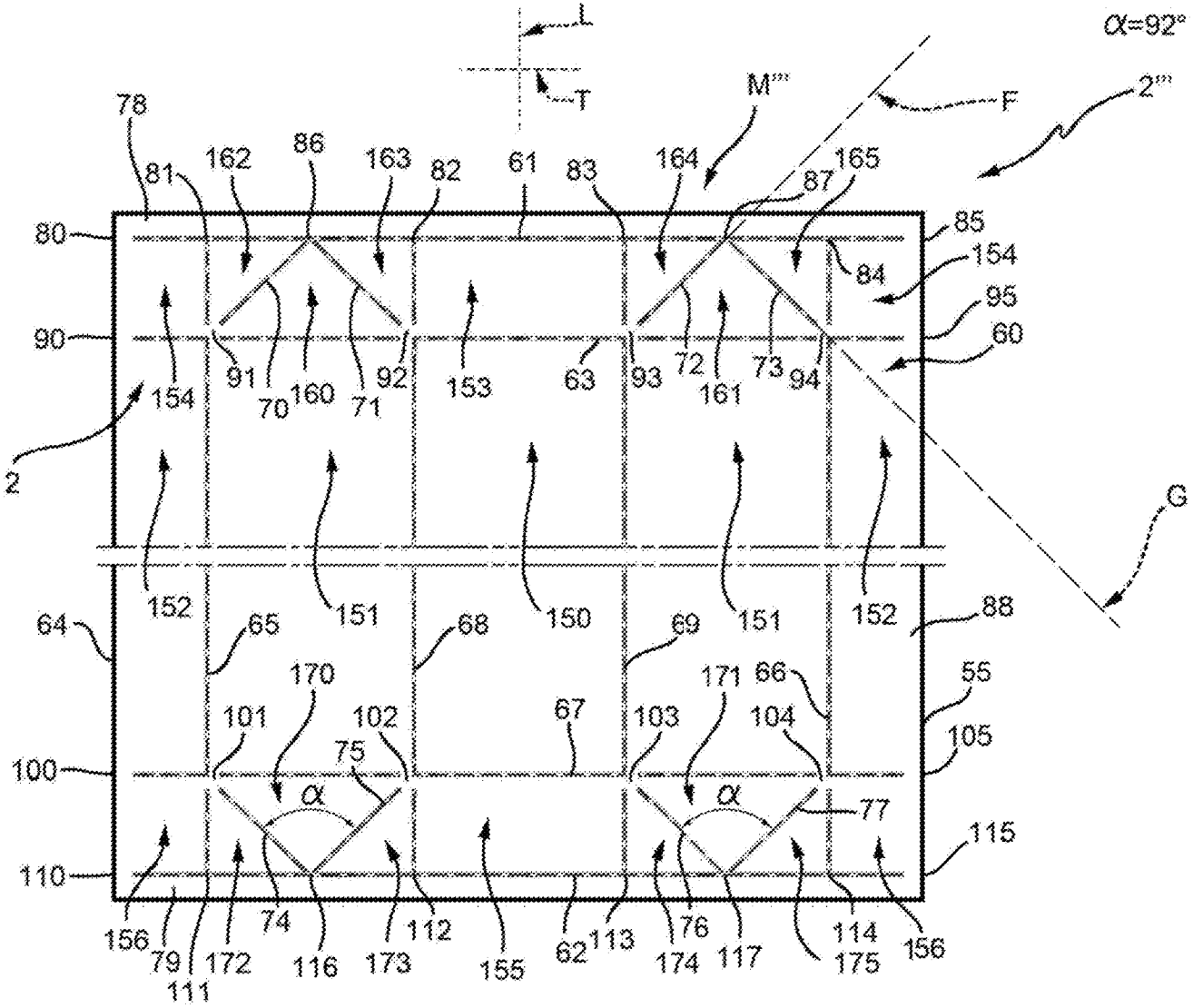

Letter M'" in FIG. 4 indicates a fourth embodiment of a basic unit of packaging material 2'", by which to produce package 1; basic units M', M'" of packaging material 2', 2'" are similar to each other, the following description is limited to the differences between them, and using the same references, where possible, for identical or corresponding parts.

In particular, basic unit M'" differs from basic unit M' in that at least one of crease lines 63, 70 and 65 is interrupted at point 91.

In the embodiment shown, each one of crease lines 63, 70, 65 is interrupted at point 91.

The prolongations of interrupted crease lines 63, 70 and 65 converge at point 91.

In particular, the portion of crease line 65 interposed between panels 152, 151 and the portion of crease line 63 interposed between panels 152, 154 are joined at point 91.

Furthermore, basic unit M'" differs from basic unit M' in that at least one of crease lines 68, 71, 63 is interrupted at point 92.

The prolongations of interrupted crease lines 68, 71 and 63 converge at point 92.

In the embodiment shown, each one of crease lines 68, 71, 63 is interrupted at point 92.

In particular, the portion of crease line 68 interposed between panels 150, 151 and the portion of crease line 63 interposed between panels 150, 153 are joined at point 92.

Furthermore, basic unit M'" differs from basic unit M' in that at least one of crease lines 69, 63, 72 is interrupted at point 93.

In the embodiment shown, each one of crease lines 69, 63, 72 is interrupted at point 93.

In particular, the portion of crease line 69 interposed between panels 150, 151 and the portion of crease line 63 interposed between panels 150, 153 are joined at point 93.

Furthermore, basic unit M'" differs from basic unit M' at least one of crease lines 66, 73, 63 is interrupted at point 94.

In the embodiment shown, each one of crease line 66, 73, 63 is interrupted at point 94.

In particular, the portion of crease line 66 interposed between panels 152, 151 and the portion of crease line 63 interposed between panels 152, 154 are joined at point 94.

Figure 5:
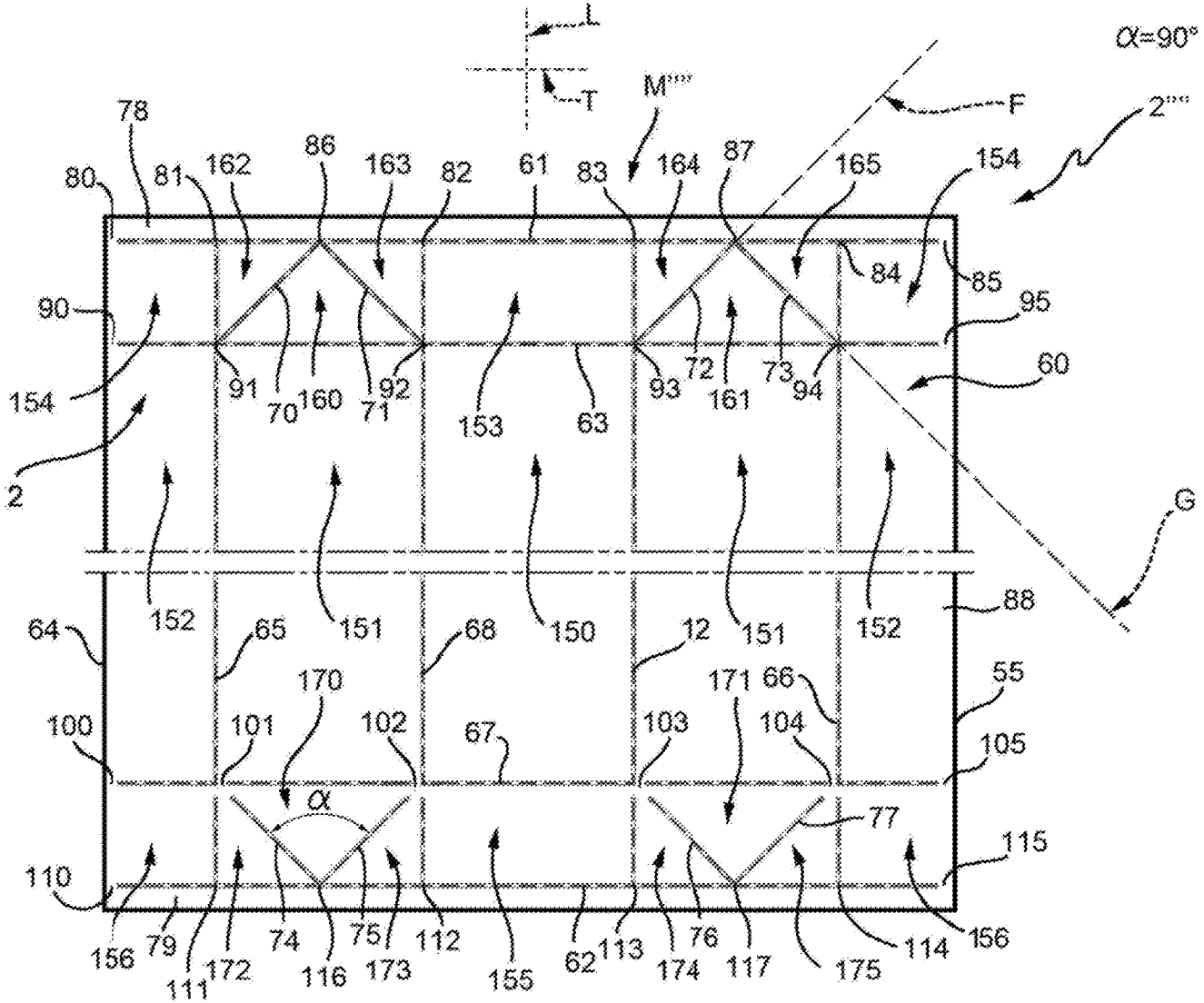

Letter M"" in FIG. 5 indicates a fifth embodiment of a basic unit of packaging material 2"", by which to produce package 1; basic units M', M"" of packaging material 2', 2"" are similar to each other, the following description is limited to the differences between them, and using the same references, where possible, for identical or corresponding parts.

In particular, basic unit M"" differs from basic unit M' in that the angle between crease lines 74, 75; 76, 77 equals 90 degrees.

Figure 6:
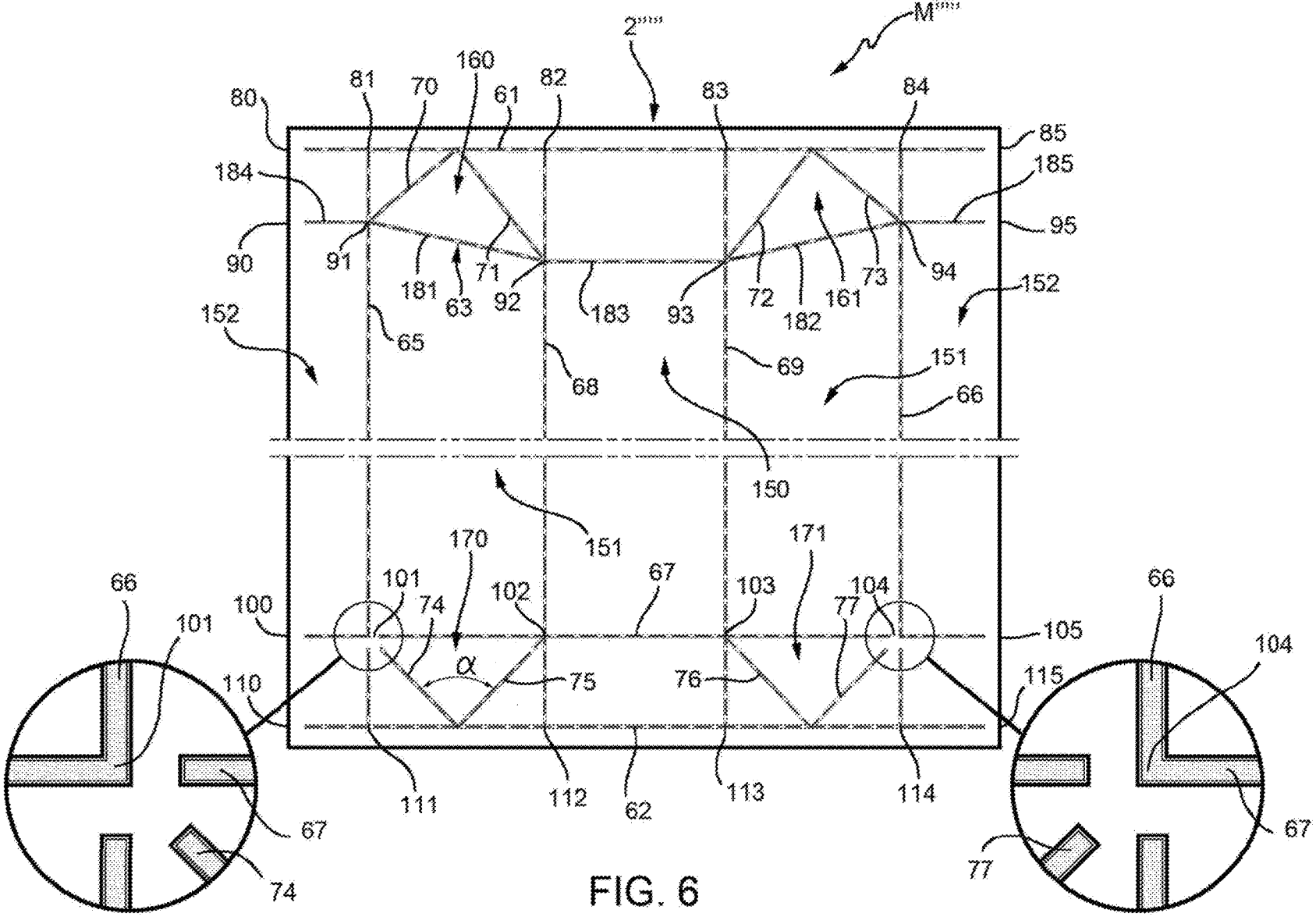

Letter M"" in FIG. 6 indicates a sixth embodiment of a basic unit of packaging material 2"", by which to produce package 1"" (FIG. 10); basic units M', M"" of packaging material 2', 2"" are similar to each other, the following description is limited to the differences between them, and using the same references, where possible, for identical or corresponding parts.

Basic unit M"" differs from basic unit M' in that crease line 63 is not a straight crease line.

In particular, crease line 63 comprises:

- a portion 181, which extends between points 91, 92 and bounds panel 160;
- a portion 182, which extends between points 93, 94 and bounds panel 161;
- a portion 183, which extends between points 92, 93 and bounds panel 150;
- a portion 184, which extends between points 90, 91 and bounds one of panel 152; and
- a portion 185, which extends between points 94, 95 and bounds the other one of panel 152.

Portion 181 is interposed between portions 183 and 184. Portion 182 is interposed between portions 183 and 185. Portions 183, 184 and 185 are parallel to each other and to crease line 61.

Portions 181, 182 are sloped with respect to portions 183, 184, 185. Portions 181, 182 are sloped with respect to crease lines 61, 65, 68, 69 and 66.

Figure 10:
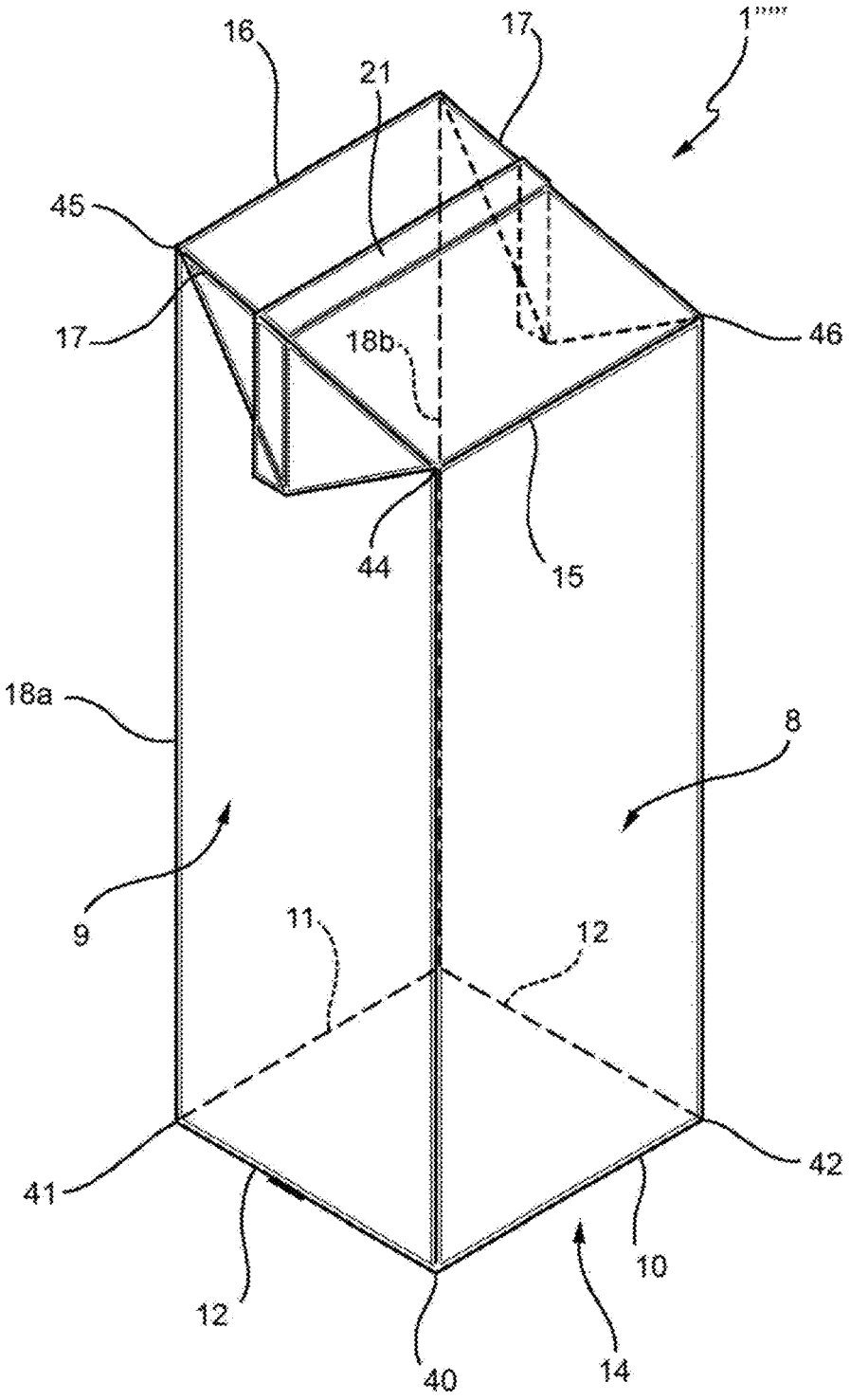
FIG. 10 shows a slanted top package formed as the sheet packaging material of FIG. 6.
Figure 12:
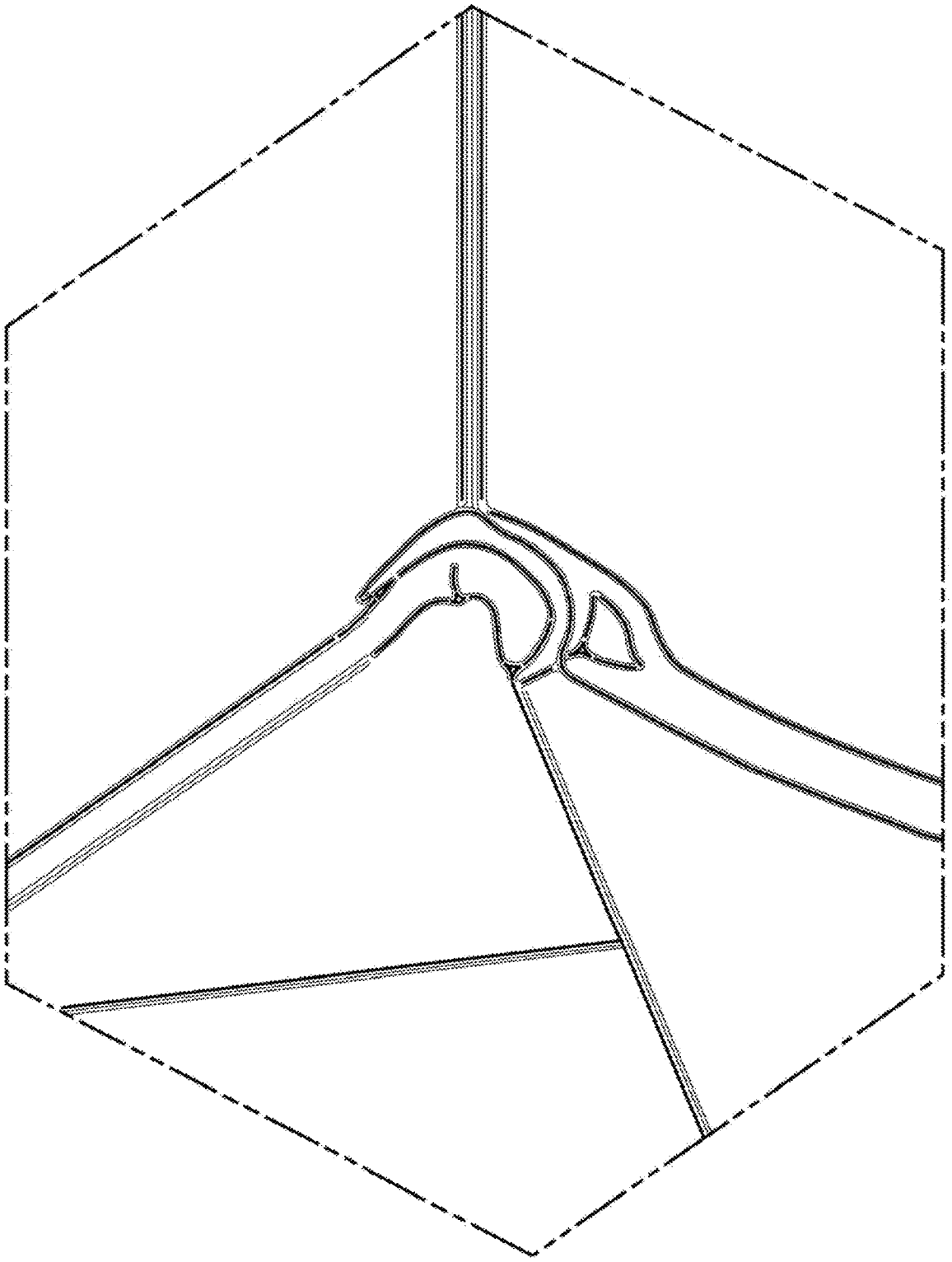
FIG. 12 shows a known package with a second kind of forming defect.

With reference to FIG. 10, packages 1, 1"" are similar to each other, the following description is limited to the differences between them, and using the same references, where possible, for identical or corresponding parts.

Package 1"" differs from package 1 in that top wall 15 is slanted with respect to bottom wall 14. In particular, the distances between edges 10, 15 is shorter than the distance between edges 11, 16.

The advantages of sheet packaging material 2, 2', 2", 2'", 2"", 2"" and respective blanks M, M', M", M'", M"", M"" according to the present invention will be clear from the above description.

In particular, at least one of longitudinal crease lines 65, 66, 68, 69 and respective transversal crease lines 67, 63 are interrupted at at least one of joining points 101, 102, 103, 104, 91, 92, 93, 94. In the same way, crease lines 74, 75, 76, 77, 70, 71, 72, 73 are interrupted at respective joining points 101, 102, 103, 104, 91, 92, 93, 94.

In other words, pattern 60 is discontinued at at least one of joining points 101, 102, 103, 104, 91, 92, 93, 94.

The Applicant has found that, due to this configuration, it possible to reduce the forming defects, which have been discussed in the introductory part of the present description.

In greater detail and especially with reference to the Tetra Brick Aseptic package 1 shown in FIGS. 8 and 10, the Applicant has found that the interruption of crease lines 65, 67, 74 at point 101 and of crease lines 66, 67, 77 at point 104 is effective in reducing the second defect acknowledged in the introductory part of the present description.

In this respect, the Applicant has found that the packaging material is made more robust especially at vertices 41, 43 by the fact that pattern 60 is interrupted at points 101, 104.

Especially with reference to the Tetra Brick Aspetic Edge package 1"" shown in FIG. 10, the Applicant has found that the occurrence and the severity of the first defect acknowledged in the introductory part of the present description is reduced by:

the interruption of crease lines 65, 67, 74 at point 101 and of crease lines 66, 67, 77 at point 104; and the interruption of crease lines 68, 67, 75 at point 102 and of crease lines 69, 67, 76 at point 103.

Furthermore, ranging angle α between 91 and 93 degrees, it is possible to optimize the interaction with the forming tool and reduce accordingly the risk of generating the first defects.

Clearly, changes may be made to sheet packaging material 2, 2', 2", 2"', 2"", 2"'" as described and illustrated herein without, however, departing from the scope defined in the accompanying claims.

In particular, only one or two of longitudinal crease lines 65, 66, 68, 69, transversal crease lines 67, 63, additional crease lines 74, 75, 76, 77, 70, 71, 72, 73 could be interrupted at respective joining points 101, 102, 103, 104, 91, 92, 93, 94.

Furthermore, transversal crease line 63, longitudinal crease lines 65, 66, 68, 69 and additional crease lines 70, 71, 72, 73 could be interrupted at joining points 91, 92, 93, 94.

Furthermore, crease lines 61, 63, 70, 71, 72, 73, 65, 68, 68, 66 of blank M, M' M"', M"" could be shaped as corresponding crease lines of blank M"'", so as to form, when folded, package 1"'".

Furthermore, blank M, M', M", M"', M"" could not comprise either second panels 162, 160 or panel 163; 164, 161, 165 or second panels 172, 170 or panel 173; 174, second panel 171, panel 175 and the resulting package 1 could therefore not comprise either top flaps 26 or bottom flaps 32.

Finally, finished package 1 could comprise one or more further walls interposed between wall 9 and wall 7 or 8.

The invention claimed is:

1. A pre-creased sheet packaging material for forming a sealed package, comprising:

a plurality of longitudinal crease lines, which extend along a longitudinal first direction of said sheet packaging material;

a plurality of transversal crease lines, which extend along a transversal second direction of said sheet packaging material, which is transversal to said first longitudinal direction;

at least one first additional crease line, which extends along a third direction, which is slanted with respect to said first longitudinal direction and said second transversal direction;

a first joining point, at which a first said longitudinal crease line and a first said transversal crease line join with respect to one another, an imaginary extension of said at least one first additional crease line intersecting with the first joining point; and at least one first area, which is bounded by at least one portion of said first longitudinal crease line, said first transversal crease line and said first additional crease line; said first area being configured to form a first folded flap of said formed package;

said third direction being incident to said first longitudinal crease line and to said first transversal crease line in said first joining point; and each one of said first longitudinal crease line, said first transversal crease line and said first additional crease line being interrupted at said first joining point.

2. The sheet packaging material of claim 1, comprising at least one second area which is configured to form a respective lateral wall of said formed package;

at least one portion of said at least one transversal crease line being interrupted at said first joining point defining an edge and a first corner of said second area.

3. The sheet packaging material of claim 1, comprising:

a second joining point, at which a second said longitudinal crease line and said first transversal crease line join with respect to one another; and at least one second additional crease line, which extends along a fourth direction, which is slanted with respect to said first longitudinal direction and said second transversal direction;

at least one third area, which is bounded by aid second longitudinal crease line, said first transversal crease line and said second additional crease line; said second area being configured to form a second folded flap of said formed package;

at least one of said second longitudinal crease line, first transversal crease line and said second additional crease line being interrupted at said second joining point.

4. The sheet packaging material of claim 3, comprising at least one second area which is configured to form a respective lateral wall of said formed package, at least one portion of said at least one transversal crease line being interrupted at said first joining point defining an edge and a first corner of said second area, and wherein said second joining point defines a further edge and a further first corner of a further second area.

5. The sheet packaging material of claim 3, wherein said further second area is configured to form a respective further lateral wall of said formed package;

at least another portion of said at least one said transversal crease line being interrupted at said second joining point defining said further edge and said further first corner of said further second area.

6. The sheet packaging material of claim 5, wherein said at least one portion of said at least one transversal crease line is interrupted at two of said first joining points defining said edge and respective said first corners of said second area;

at least another portion of said at least one said transversal crease line being interrupted at said second joining points defining said further edge and respective said further first corners of said further second area.

7. The sheet packaging material of claim 5, comprising:

a second transversal crease line, which bounds said first area; and a first end edge, which extends parallel to said transversal second direction; and said second transversal crease line being interposed between said first transversal crease line and said first end edge along said longitudinal first direction.

8. The sheet packaging material of claim 7, comprising:

a second end edge, which extends parallel to said transversal second direction;

a third transversal crease line and a fourth transversal crease line, which extends parallel to said transversal second direction;

at least one third additional crease line, which extends along a fourth direction slanted with respect to said first longitudinal direction and said second transversal direction;

a third joining point, at which said first longitudinal crease line and said third transversal crease line join with respect to one another;

at least one fourth area, which is bounded by said first longitudinal crease line, said third transversal crease line and said third additional crease line;

said fourth direction being incident to said first longitudinal crease line and to said third transversal crease line in said third joining point;

at least one of said first longitudinal crease line, third transversal crease line and third additional crease line being interrupted at said third joining point.

9. The sheet packaging material of claim 1, characterized by comprising at least one third area interposed between two said first areas, said first and third areas making up said flaps, to be folded onto a bottom wall of said finished package;

said third area being bounded by said first transversal crease line and by a pair of additional crease lines.

10. The sheet packaging material of claim 1, wherein said first additional crease line and said second additional crease line are incident relative to one another and define therebetween an angle ranging between 91 and 93 degrees.

11. A sheet packaging material of claim 1, wherein the sheet packaging material is a continuous web of packaging material.

12. A sealed package for pourable food products, the sealed package being formed from the pre-creased sheet packaging material according to claim 1;

said package comprising:

a top wall and a bottom wall opposite to another; and a plurality of lateral walls, interposed between said top wall and said bottom wall.

13. The sealed package of claim 12, comprising at least one first vertex arranged at an intersection of a first contour of at least one of said lateral wall with a second contour of at least one of said top wall and said bottom wall;

said first vertex being defined by said first joining point of the sheet packaging material.

14. The sealed package of claim 13, wherein said at least one first vertex is arranged at the intersection of said first contour of at least one of said lateral wall with said second contour of said bottom wall.

15. The sealed package of claim 12, wherein said at least one of said lateral walls is a rear wall.

16. The sealed package of claim 12, wherein said top wall is slanted with respect to said bottom wall and with respect to said lateral walls.

17. A method of manufacturing a sealed package according to claim 12, comprising folding the pre-creased sheet packaging material along said longitudinal crease lines and said transversal crease lines.

* * * * *